United States Patent [19]

Blitzer, Jr.

[11] 4,189,888

[45] Feb. 26, 1980

[54] DECORATIVE CEILING SYSTEM

[76] Inventor: Jacob H. Blitzer, Jr., 2231 Colby Ave., Los Angeles, Calif. 90064

[21] Appl. No.: 882,560

[22] Filed: Mar. 2, 1978

[51] Int. Cl.[2] ..... E04B 5/52

[52] U.S. Cl. ..... 52/484; 52/311; 52/316

[58] Field of Search ..... 52/311-316, 52/484

[56] References Cited

U.S. PATENT DOCUMENTS

| | | | |
|---|---|---|---|
| 2,843,889 | 7/1958 | Keller | 52/312 |
| 3,418,766 | 12/1968 | Jackson | 52/311 X |
| 3,458,386 | 7/1969 | Shanok et al. | 52/312 X |
| 3,504,463 | 4/1970 | Akerson | 52/316 |
| 3,661,613 | 5/1972 | Contrael et al. | 52/316 |
| 3,834,102 | 9/1974 | Adams | 52/311 |

FOREIGN PATENT DOCUMENTS

| | | | |
|---|---|---|---|
| 1287876 | 2/1962 | France | 52/311 |

*Primary Examiner*—J. Karl Bell

*Attorney, Agent, or Firm*—Spensley, Horn, Jubas & Lubitz

[57] ABSTRACT

Although utilizing an inverted T-bar suspension grid, this ceiling system presents a continuous decorative relief pattern that is visually uninterrupted by T-bars. To this end, each ceiling panel consists of a thin plastic sheet molded to form a three-dimensional decorative relief pattern of symmetric design. The T-bar flanges are covered with thin plastic facing strips having repetitive geometric design elements relief molded therein. Each ceiling panel also includes a molded peripheral shoulder recessed from the adjacent panel surface by an amount at least equal to the combined thickness of the T-bar flange and the facing strip. When the panels are supported by the grid with the recessed shoulders seating on the T-bar flanges, the facing strip design elements align with the symmetric relief pattern of the ceiling panel to present a visually uninterrupted decorative ceiling.

9 Claims, 8 Drawing Figures

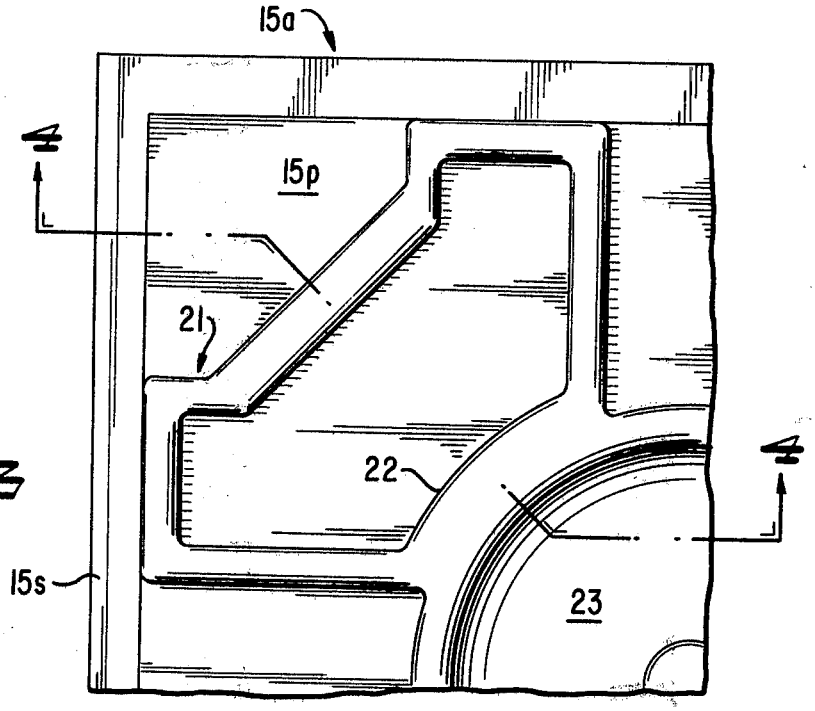
FIG. 3
FIG. 4
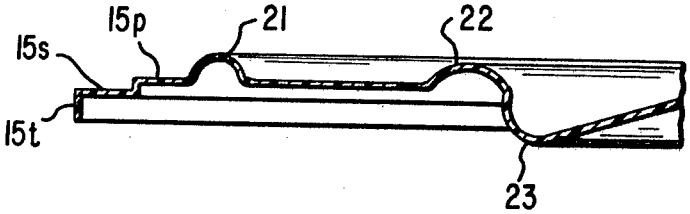
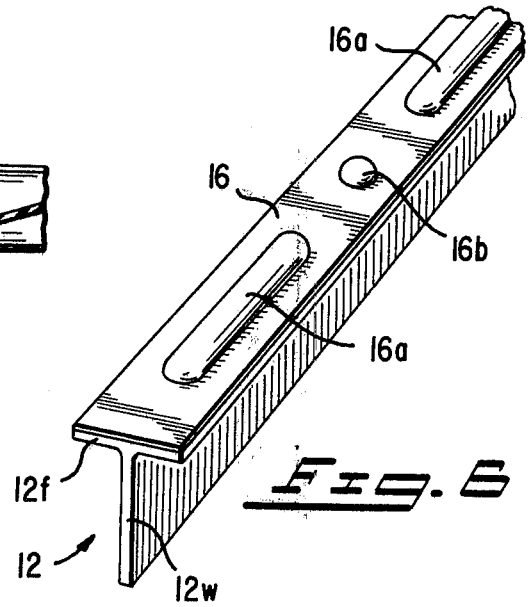
FIG. 6
FIG. 5
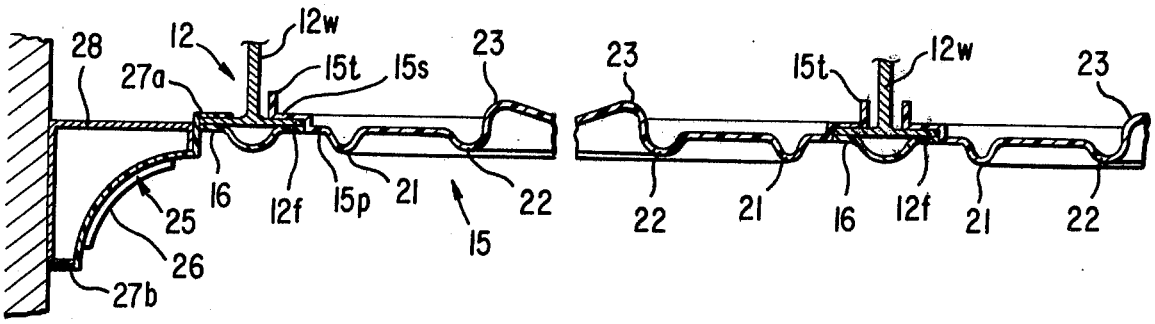

DECORATIVE CEILING SYSTEM

BACKGROUND OF THE INVENTION

1. Field of the Invention

The present invention relates to an inverted T-bar suspension ceiling which presents a continuous decorative relief pattern that is visually uninterrupted by T-bars.

2. Description of the Prior Art

Decorative ceilings of sculptured, relief design were popular in England at the end of the 19th centry. In those ceilings, sculptural effects were carved in plaster. In the United States, the high cost of such individually carved plaster ceilings prevented their widespread acceptance. Instead, during the Victorian design period around the turn of the century, decorative relief ceilings were recreated in pressed metal.

In such "Victorian" ceilings, an attractive design was stamped into metal panels. These were nailed to wooden ceiling supports. Nails with round or other shaped head were used to mount the metal panels. The nails were symmetrically spaced so as to become part of the ceiling design.

Today, there is a resurgence of interest in such Victorian design panel ceilings. However, the installed cost makes such ceilings less acceptable in today's markets. Thus, in addition to the high installation cost and expense of the metal panels, today's building code flammability requirements would usually prevent the use of a wooden nailing base. Moreover, the metal panels could not be mounted beneath fire sprinklers so as to conceal them visually. In addition, metal panels have a high sound reflectivity, making their use undesirable in places where a quiet environment is sought.

An objective of the present invention is to provide a ceiling which can simulate a Victorian design, but which uses materials and suspension techniques that are relatively inexpensive and are compatible with today's construction methods and building code requirements. The ceiling panels of the present invention may be mounted beneath fire sprinklers so as to conceal them from view. Acoustic absorption material may be used in conjunction with the present invention to achieve sound absorption without affecting the apperance of the ceiling.

The present invention employs an inverted T-bar suspension grid. This type of ceiling support is economical and has gained widespread acceptance. However, it has the disadvantage that the exposed T-bar flanges are so commonplace as to detract substantially from the aesthetic appearance of the ceiling.

Several approaches have been used in the past to overcome this problem. In suspended acoustical ceilings, the sound-absorbing panels are of sufficient thickness to permit the formation of a groove in the edge of the panel which received the T-bar flange. This approach is unsatisfactory for use with ceilings panels formed of very thin material. Another approach has been to cover the exposed surface of the T-bar flange with a flat strip of metal having an enamel or a polished finish. Alternatively, flat strips of vinyl fabric have been used, typically ones having a simulated wood grain. While these approaches may improve the appearance of the ceiling, none incorporates three-dimensional design elements which blend into the overall ceiling design, as is another objective of the present invention.

SUMMARY OF THE INVENTION

These and other objectives are achieved in the inventive decorative ceiling system which, though utilizing an inverted T-bar suspension grid, presents a continuous decorative relief pattern that is visually uninterrupted by the T-bars. To this end, each ceiling panel is formed of a very thin sheet of thermo-plastic material which is vacuum molded to provide a three-dimensional decorative relief pattern of symmetric design. Simultantously molded in each panel is a peripheral recessed shoulder and an edge lip. Advantageously, the panels are screened or otherwise treated to have a coloration reminiscent of embossed metal.

Each T-bar flange is covered with a thermo-plastic facing strip which itself is vacuum molded to form a relief design of repetitive geometric elements. These elements and the symmetric design of the ceiling panels are arranged so that when installed, the facing strip pattern becomes an integral part of the overall ceiling design. In this manner, the ceiling design is visually uninterrupted by the T-bars.

The recessed shoulders formed in each panel further this objective. To that end, the depth of each recess corresponds to the combined thickness of the T-bar flange and the material thickness of its facing strip. The width of the panel recess generally corresponds to the distance which the T-bar flange projects from the web. This ensures that when the panel is installed with the recess seated on the upper surface of the T-bar flange, the bottom surface of the flange facing strip will be substantially co-planar with the adjacent face portions of the panel.

Each panel may be vacuum formed from a thermoplastic material such as polyvinyl chloride. Very thin sheets of this material, typically less than 1/16th of an inch thick, may be employed. Material costs are low, yet a ceiling of very attractive design is achieved. Cornice members may be formed of like material and employed advantageously with the inventive ceiling. Fire sprinklers may be mounted within the plenum above the ceiling, totally out of view. Sound absorption panels or material also may be mounted out of sight in the plenum.

BRIEF DESCRIPTION OF THE DRAWINGS

A detailed description of the invention will be made with reference to the accompanying drawings, wherein like numerals designate corresponding elements in the several figures, which are not to scale.

FIG. 3 is a fragmentary perspective view of a corner portion of a typical ceiling panel.

FIG. 4 is a sectional view of the ceiling panel of FIG. 3 as viewed along the line 4—4 thereof.

FIG. 5 is a simplified sectional view of the assembled ceiling system.

FIG. 6 is a perspective view of a T-bar and its associated facing strip, as used in the ceiling of FIG. 1.

DESCRIPTION OF THE PREFERRED EMBODIMENT

The following detailed description is of the best presently contemplated mode of carrying out the invention.

This description is not to be taken in a limiting sense, but is made merely for the purpose of illustrating the general principles of the invention since the scope of the invention best is defined by the appended claims.

Figure 1:
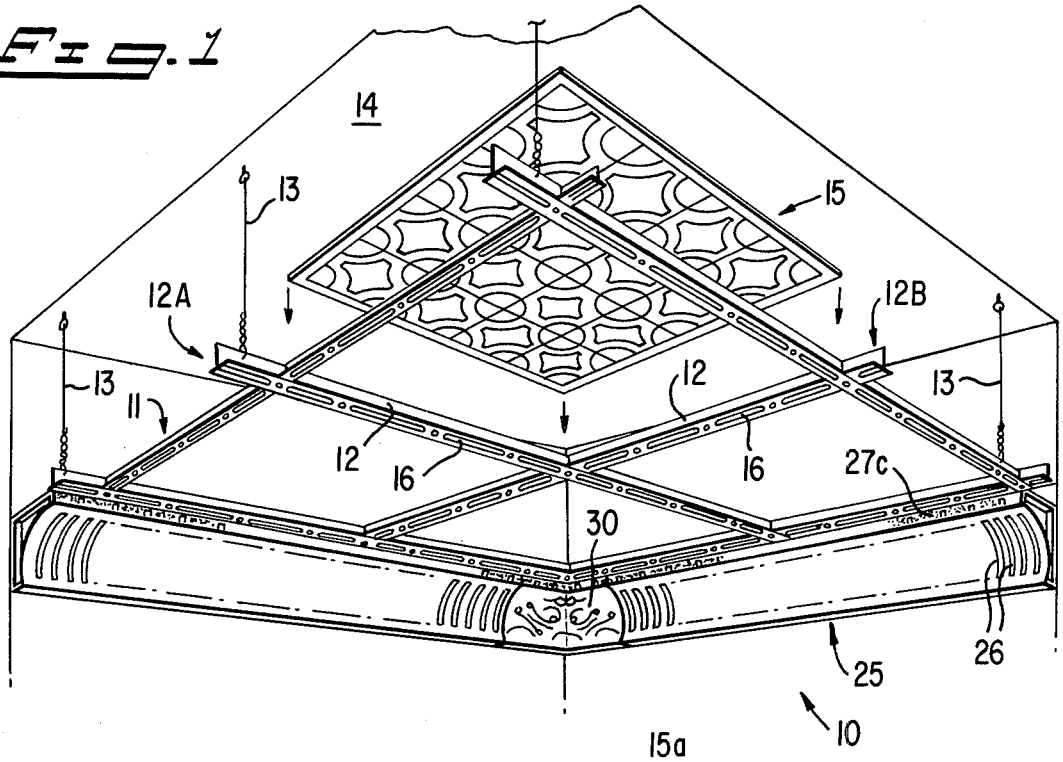
FIG. 1 is a perspective view, of the inventive ceiling system.

A typical decorative ceiling system 10 in accordance with the present invention is shown in FIG. 1. The system includes a grid 11 of T-bars 12 suspended in a conventional manner by wires 13 from an architectural ceiling 14 of concrete or other material. The grid main runners 12A and cross runners 12B are positioned to accommodate a plurality of like panels 15 described in detail below.

Molded in each panel 15 is a three-dimensional decorative relief pattern of symmetric design. The bottom face of each T-bar 12 is covered with a cover cap or facing strip 16, relief molded in which is a pattern of repetitive geometric design elements **16*a*, 16*b* (FIG. 6). The symmetric design of the panel 15 relief pattern is arranged to have elements which align with the repetitive design elements 16*a*, 16*b* which are relief molded in the facing strip 16. In this manner, when the panels 15 are seated in place in the grid 11, the panels and the facing strips 16** together give the appearance of a continuous ceiling pattern that is visually uninterrupted by exposed T-bars.

Figure 2A:
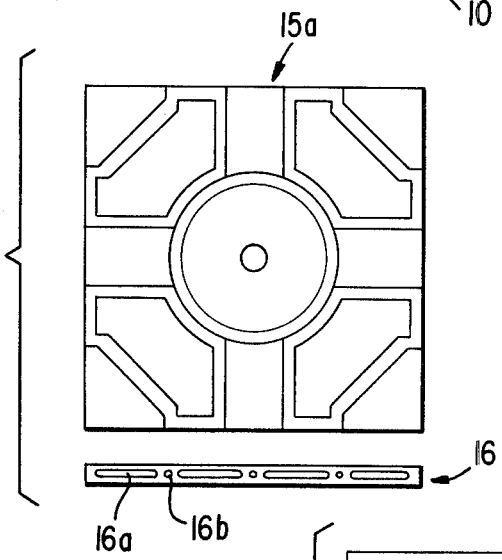
FIGS. 2A, 2B and 2C are plan views of typical symmetric designs for the ceiling panels utilized in the present invention.
Figure 2B:
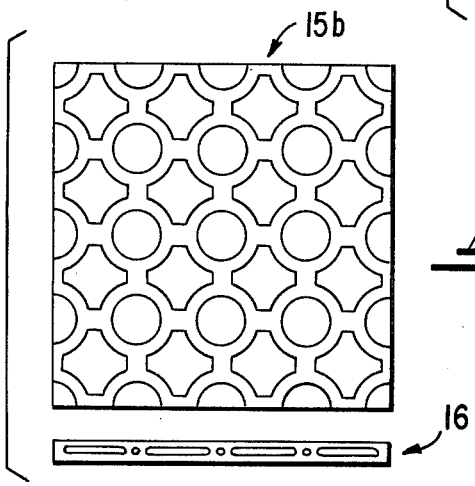
Figure 2C:
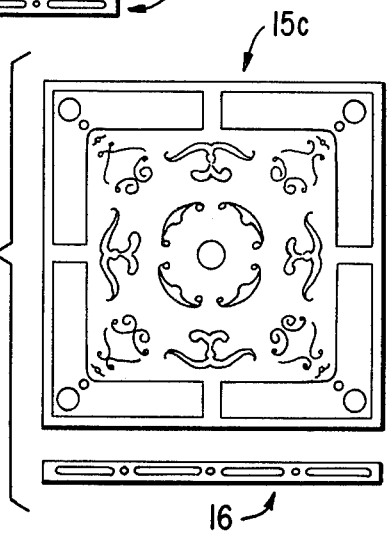

Three typical symmetric panel designs are shown respectively in FIGS. 2A, 2B and 2C. In each instance, the panel **15*a*, 15*b*, 15*c* includes design elements which align with the repetitive relief elements 16*a*, 16*b* in the adjacent facing strip. The three illustrated panel designs, though different from one another, all have design elements which align with the same facing strip 16**. Such arrangement, though not necessary, is advantageous since the same facing strip can be employed for installations with different panel designs. Alternatively, separate facing strips may be used having different repetitive geometric design elements configured to align with independent panel designs.

Advantageously, each ceiling panel 15 is formed by vacuum molding a sheet of thermoplastic material such as polyvinyl chloride. Quite thin material can be used. For example, commercially acceptable panels 15 having an overall dimension of approximately two feet square may be formed of polyvinyl chloride having a thickness on the order of fifteen mils. However, panels of greater or lesser thickness may be employed.

The three-dimensional characteristics of the panel 15 are illustrated in FIGS. 3, 4 and 5. The typical design elements 21, 22, 23 are molded so as to project forwardly or rearwardly from the major plane **15*p* of the face of the panel 15**.

The uninterrupted appearance of the installed ceiling is aided by the utilization of a recessed shoulder **15*s* at the periphery of each panel 15. Advantageously, the width of the shoulder 15*s* is slightly less than the extent of horizontal projection of the flange 12*f* from the web 12*w* of the T-bar 12, as shown in FIG. 5. The depth of the recess 15*s* with respect to the plane 15*p* is preferrably equal to the combined thickness of the T-bar flange 12*f* and the material thickness of the facing strip 16. Thus when assembled as shown in FIG. 5, the panel face plane 15*p* is generally aligned with the exposed surface of the facing strip 16**.

Optionally, the panel 15 may be provided with a lip **15*t* (FIGS. 4 and 5) at the outer edge of the shoulder 15*s*. For a panel 15 formed of thin sheet material, the lip 15*t*** adds to the panel rigidity.

The facing strip 16 may be formed of the same material as the panels 15. The relief elements **16*a*, 16*b* advantageously are formed by vacuum molding and all project in the same direction, i.e., away from the T-bar 12. The facing strip 16 may be adhesively bonded to the T-bar flange 12*f*. Alternatively, the facing strip 16 may be configured to have folded-back longitudinal edges (not illustrated) which clip over the respective edges of the T-bar flange 12*f***.

An attractive border for the ceiling 10 is provided by a cornice (FIGS. 1 and 5) 25 that is also formed of thin sheet material such as polyvinyl chloride. The cornice 25 may consist of relatively long (i.e., two feet or more) sections each having the curved cross-section illustrated in FIG. 5. Molded relief ribs 26 both add rigidity to the structure and enhance the visual appearance of the cornice. Integrally molded flanges **27*a*, 27*b* aid in the attachment of the cornice 25 to an appropriate bracket 28 and may themselves contain relief elements 27*c* which become part of the three-dimensional ceiling design. A separate cornice corner 30 may be formed of a like material, relief molded to include both decorative elements and top and bottom edge flanges like the cornice flanges 27*a*, 27*b*** to assist mounting.

In embodiments of the present invention using very thin material for the panels 15, only negligible noise reduction may be provided by the ceiling system 10. If substantial sound reduction is desired, acoustical absorption material may be installed above the ceiling 10 to accomplish this objective. For example, conventional acoustical ceiling panels may be mounted directly to the architectural ceiling 14. Noise reduction will be accomplished without altering the decorative appearance of the ceiling 10.

Fire sprinklers also may be mounted in the plenum between the grid 11 and the architectural ceiling 14. With such arrangement, the sprinklers are hidden out of sight above the panels 15, and do not interfere the decorative appearance of the ceiling system 10.

A particularly attractive appearance for the inventive ceiling may be achieved by coloring the panels 15 and the facing strip 16 to simulate the metallic appearance of a Victorian ceiling. Such coloration advantageously may be achieved by screened application of inks or other coloring material onto the panel 15 after it has been vacuumed formed.

I claim:

1. A decorative ceiling system comprising:

an inverted T-bar grid suspendable from an overhead structure, each T-bar in said grid having a vertical web and a horizontal flange;

a decorative plastic facing strip bonded to the bottom face of each inverted T-bar flange, said facing strip having repetitive design elements relief molded therein, and a plurality of like panels supported by said grid, each panel having:

like one of a plurality of different three dimensional decorative relief patterns of symmetric design molded therein, and a peripheral shoulder recessed from the immediately adjacent panel design surface, said shoulder having a uniform width generally corresponding to the extent of projection of said T-bar flange to one side of said web, each of said plurality of different panel symmetric designs having relief pattern elements which align with the relief molded repetitive design elements of said facing strip, so that said panels and said facing strips together give the appearance of a continuous geometric and symmetric pattern visually uninterrupted by T-bars.

2. A decorative ceiling system according to claim 1 wherein each panel further includes a peripheral lip extending perpendicularly rearwardly from the edge of said shoulder.

3. A decorative ceiling system according to claim 2 wherein each panel comprises a thermoplastic material that is vacuum molded simultaneously to form said relief pattern, said shoulder and said lip, the material thickness of each panel being less than about one-eighth inch.

4. A decorative ceiling system according to claim 3 together with a cornice of arcuate cross-section, said cornice being formed of thermoplastic material of thickness corresponding to that of said panels and having three-dimensional decorative elements relief molded therein at locations which align with relief pattern elements in the symmetric design of said panels.

5. A decorative ceiling system according to claim 3 wherein each panel includes screened-on coloration which, together with said symmetric design, simulates a Victorian ceiling.

6. A decorative ceiling system according to claim 1 together with acoustical absorbtion material attached to said overhead structure above said T-bar grid and supported panels.

7. A decorative ceiling system according to claim 1 together with fire sprinklers mounted in the plenum above said T-bar grid and supported panels.

8. For use in a decorative system of the type employing panels having one of a plurality of different symmetric designs formed therein, a support member comprising a T-bar and a plastic facing strip bonded to the flange of said T-bar, said facing strip having a linear repetitive set of geometric elements relief molded therein, said elements being positioned to align with elements in each of the different symmetric designs of a ceiling panel supported by said T-bar.

9. A decorative ceiling system according to claim 1 wherein the depth of recess of said shoulder from the adjacent panel surface is at least equal to the combined thickness of said T-bar flange and the facing strip thickness.

* * * * *